US010405636B2

(12) United States Patent
Kang

(10) Patent No.: US 10,405,636 B2
(45) Date of Patent: Sep. 10, 2019

(54) COSMETIC CONTAINER HAVING AIR ENTRANCE/EXIT MEMBER

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 153 days.

(21) Appl. No.: 14/908,923

(22) PCT Filed: Jul. 28, 2014

(86) PCT No.: PCT/KR2014/006856
§ 371 (c)(1),
(2) Date: Jan. 29, 2016

(87) PCT Pub. No.: WO2015/016545
PCT Pub. Date: Feb. 5, 2015

(65) Prior Publication Data

US 2016/0157585 A1 Jun. 9, 2016

(30) Foreign Application Priority Data

Jul. 29, 2013 (KR) ..... 20-2013-0006315 U

(51) Int. Cl.
*A45D 40/22* (2006.01)
*A45D 33/00* (2006.01)
(Continued)

(52) U.S. Cl.
CPC ..... *A45D 40/222* (2013.01); *A45D 33/006* (2013.01); *A45D 33/24* (2013.01);
(Continued)

(58) Field of Classification Search
CPC .... A45D 33/006; A45D 33/24; A45D 40/222; A45D 40/0068; A45D 34/00;
(Continued)

(56) References Cited

U.S. PATENT DOCUMENTS 2,554,489 A * 5/1951 Crane ..... A45D 33/005 118/308
4,318,494 A * 3/1982 Heyn ..... B65D 17/165 220/271
(Continued)

FOREIGN PATENT DOCUMENTS

JP 03-110140 U 11/1991
KR 20-0306854 Y1 3/2003
(Continued)

*Primary Examiner* — Anthony D Stashick
*Assistant Examiner* — James M Van Buskirk
(74) *Attorney, Agent, or Firm* — Heedong Chae; Lucem, PC

(57) ABSTRACT

The present invention relates to a cosmetic container having an air entrance/exit member, wherein an outer container cap (20) is opened/closed at an outer container (10), a cosmetic container (30) is coupled to the inside of the outer container (10), and a sealing cap (60) is opened/closed at the cosmetic container (30). The sealing cap (60) includes: a sealing plate (62) for covering the cosmetic container (30); a sealing protrusion wheel (64) formed at the lower surface of the sealing plate (62); and an air entrance/exit member (66) insertedly provided into the sealing plate (62), wherein a coupling hole (621) to which the air entrance/exit member (66) is coupled is formed at the sealing plate (62), plurality of ribs (622) are formed around the coupling hole (621), and slits (623) through which air communicates are formed between the ribs (622).

11 Claims, 13 Drawing Sheets

(51) Int. Cl.

| | |
|---|---|
| ***A45D 40/00*** | (2006.01) |
| ***A45D 34/00*** | (2006.01) |
| ***B65D 25/28*** | (2006.01) |
| ***B65D 43/16*** | (2006.01) |
| ***B65D 51/18*** | (2006.01) |
| ***A45D 33/24*** | (2006.01) |

(52) U.S. Cl.
CPC ..... *A45D 34/00* (2013.01); *A45D 40/0068* (2013.01); *B65D 25/28* (2013.01); *B65D 43/16* (2013.01); *B65D 51/18* (2013.01); *A45D 2040/223* (2013.01); *A45D 2200/051* (2013.01); *B65D 2251/009* (2013.01); *B65D 2251/0021* (2013.01); *B65D 2251/0028* (2013.01); *B65D 2251/0084* (2013.01)

(58) Field of Classification Search
CPC ..... A45D 2200/051; A45D 2040/223; A45D 40/22; A45D 40/00; B65D 25/28; B65D 43/16; B65D 51/18; B65D 51/16; B65D 2251/0021; B65D 2251/0028; B65D 2251/0084; B65D 2251/009; B65D 2205/00; B65D 2543/00546; B65D 17/165; G01M 3/32; G01M 3/3272
USPC ..... 220/254.6, 254.3, 254.1, 259.2, 259.1, 220/256.1, 367.1; 206/581; 132/293, 132/300, 294
See application file for complete search history.

(56) References Cited

U.S. PATENT DOCUMENTS

| | | | | |
|---|---|---|---|---|
| 7,597,211 | B2 * | 10/2009 | Kang ..... | A45D 33/006 132/293 |
| 2005/0269325 | A1 * | 12/2005 | Belcastro ..... | A47G 23/0233 220/254.3 |

FOREIGN PATENT DOCUMENTS

| | | | |
|---|---|---|---|
| KR | 20-0311423 | Y1 | 4/2003 |
| KR | 10-2012-0045146 | A | 5/2012 |

* cited by examiner

COSMETIC CONTAINER HAVING AIR ENTRANCE/EXIT MEMBER

TECHNICAL FIELD

The present invention relates to a cosmetic container having an air entrance/exit member, and more specifically, to a cosmetic container having an air entrance/exit member, which is provided with a sealing cap in order to prevent water and volatile ingredients from being evaporated and volatilized from cosmetics, such as foundation or cosmetic cream, containing a large quantity of water or volatile ingredients such as an alcohol. In addition, a sealing cap is provided with an air entrance/exit member for preventing water and volatile ingredients from being evaporated and volatilized since air is compressed when the cosmetic container is closed with a sealing cap so that the sealing cap may not be properly closed. Furthermore, the cosmetic container is capable of allowing the sealing cap to be completely closed to prevent water and volatile ingredients of cosmetics from being evaporated and volatilized and improving a phenomenon that cannot open the sealing cap due to a vacuum state formed by a pressure reduction phenomenon when opening the sealing cap.

BACKGROUND ART

In general, since cosmetics contain a large quantity of water or volatile ingredients, if a cosmetic container is not perfectly air-tightened, the water and volatile ingredients are evaporated and volatilized, so that the quantity of cosmetics is reduced. In addition, when the water and volatile ingredients are evaporated and volatilized, the mixing ratio between cosmetic ingredients is varied so that the performance of the cosmetics is deteriorated.

In addition, when the water and volatile ingredients of cosmetics are evaporated and volatilized, since the cosmetics are dried so that the original function of cosmetics is lost, it is very important to keep the cosmetics to maintain the original ingredients of the cosmetics.

To solve the above-described problems, according to the related art, a sealing cap for maintaining the air tightness is installed to a cosmetic container such that the water and volatile ingredients are prevented from being evaporated and volatilized. In addition, according to the related art, an elastic packing for maintaining the air tightness of a cosmetic container containing cosmetics is installed to the cosmetic container to secure the air tightness.

As shown in FIG. 1, a cosmetic container 200 having a sealing cap according to the related art includes an elastic packing 220 installed in a space between inner and outer walls 201 and 202 of the cosmetic container 200 conventionally containing cosmetics 221, and a sealing protrusion 241 formed on the sealing cap 240 configured to be opened and closed about a binge 250. Thus, the sealing protrusions 241 of the sealing cap 240 presses the packing 220 of the cosmetic container 200, so that the cosmetic container is sealed.

However, according to the cosmetic container 200 of the related art, the sealing cap 240 is maintained in a flat shape all the times to allow the sealing protrusion 241 to uniformly press all the surfaces of the packing 220 of the cosmetic container 200, so that the sealing may be maintained. Since the sealing cap 240 is generally formed of synthetic resin, the sealing cap 240 is hardened over time, so that the flatness is varied due to a shrink or warp phenomenon, thereby deteriorating the sealing.

Accordingly, to solve the problems of the cosmetic container according to the related, as shown in FIG. 2, the applicant of the present application had proposed a sealing-enhanced cosmetic container 100 disclosed in Korean Registered Utility Model No. 20-0306854.

The sealing-enhanced cosmetic container 100 proposed includes an elastic packing 125 installed in a space between inner and outer walls 123 and 124 of the cosmetic container 100 containing cosmetics 121, and a sealing protrusion 128 formed on a sealing cap 126 configured to be opened and closed about a hinge 127, such that the sealing protrusion 128 of the sealing cap 126 presses the packing 125 of the cosmetic container 100. In addition, a pressing rod 116 is further formed in an outer cap 124 configured to be opened or closed about a hinge 115, such the pressing rod 116 of the outer cap 114 presses the closed sealing cap 126 once more again, thereby enhancing the sealing.

However, according to the cosmetic container 100 of the related art, since, when the pressing rod 116 of the outer cap 114 presses several points of the sealing cap 126 with the same force, the sealing is enhanced, it is required to form a plurality of pressing rods 116 on the outer cap 114, so that the productivity is deteriorated and the producing cost is increased, thereby deteriorating the product competitiveness.

To solve the problems, as shown in FIG. 3, there has been disclosed a cosmetic container in which a sealing protrusion wheel 322 formed on a cap 320 is tightly press-inserted into an inlet of the cosmetic container 300. However, since the sealing protrusion wheel 322 is tightly press-inserted into the inlet of the cosmetic container 300, when the cap 320 is closed, the air in the cosmetic container 300 is compressed so that the air pressure is increased, so the cap 320 bounces upward against the cosmetic container 300 to be opened again. In addition, even though the cap 320 is forcibly closed, when it is attempted to open the cap 320 in order to use cosmetics, the cap 320 is not opened due to the vacuum pressure generated in the cosmetic container 300.

DISCLOSURE

Technical Problem

To solve the problems described above, an object of the present invention is to provide a cosmetic container which includes an air entrance/exit member installed on a sealing cap to prevent air therein from being compressed when the cosmetic container is closed with the sealing cap, such that the sealing cap is prevented from being opened while bouncing upward.

Another object of the present invention is to provide a cosmetic container which includes a handle having a hinge provided on an air entrance/exit member installed on a sealing cap to prevent a pressure reducing phenomenon from occurring when opening the sealing cap, such that the sealing cap is prevented from being not opened due to vacuum.

Still another object of the present invention is to provide a cosmetic container which includes a packing installed on an air entrance/exit member installed on a sealing cap such that the sealing is improved and the air entrance/exit member is easily assembled with the sealing cap.

Still another object of the present invention is to provide a cosmetic container which includes a sealing protrusion wheel which extends from a lower surface of a sealing cap and is tightly press-inserted into an inlet of the cosmetic container, such that the cosmetic container is perfectly sealed.

Still another object of the present invention is to provide a cosmetic container which includes a sealing extension protrusion wheel, which extends integrally from an inlet of a sealing cap and into which a sealing protrusion wheel of the sealing cap is tightly press-inserted, such that the sealing of the cosmetic container is enhanced.

Technical Solution

The present invention provides a cosmetic container having an air entrance/exit member, which includes an outer container (10); an outer container cap (20) opened or closed on the outer container (10); a cosmetic container (30) coupled to an inside of the outer container (10); and a sealing cap (60) opened or closed on the cosmetic container (30), wherein the sealing cap (60) includes a sealing plate (62) for covering the cosmetic container (30); a sealing protrusion wheel (64) formed at a lower surface of the sealing plate (62); and the air entrance/exit member (66) installed to the sealing plate (62), wherein a coupling hole (621), into which the air entrance/exit member (66) is coupled, is formed in the sealing plate (62), and a plurality of ribs (622) is formed near the coupling hole (621) so that slits (623) through which air flows are formed between the ribs (622).

A reinforcing band (68) protrudes integrally from an outer periphery surface of the sealing plate (62) and a cut surface (681), into which a handle (661) is inserted, is formed at one side of the reinforcing band (68). A hinge support (682) for supporting a hinge (662) of the handle (661) of the air entrance/exit member (66) is formed on the cut surface (681), and hinge holes (683), into which the hinges (662) of the handle (661) of the air entrance/exit member (66) are inserted, are formed on both side ends of the reinforcing band (68) which are formed by the cut surface (681).

The air entrance/exit member (66) includes a cover plate (663) for covering the upper portion of the coupling hole (621) of the sealing cap (60); a coupling rod (664) integrated with a lower portion of the cover plate (663) and inserted into the coupling hole (621) of the sealing cap (60); a packing-separation preventing protrusion wheel (665) integrally extending from an end of the coupling rod (664) to prevent the packing (67) from being separated; and a shrinkage hole (666) formed at the center of the coupling rod (664) to allow the coupling rod (664) to shrink such that the sealing cap (60) is easily coupled into the coupling hole (621).

The handle (661) may be integrally formed at one side of the air entrance/exit member (66), and the hinge (662), which is inserted into a hinge hole (683) and is put on the hinge support (682) of the sealing cap (60), is formed in the handle (661).

The packing (67), which is fitted with the coupling rod (664) of the air entrance/exit member (66), is not separated from the coupling rod (664) by a packing-separation preventing protrusion wheel (665) on an end of the coupling rod (664).

The packing (67) includes a coupling hole (671) which is formed at the center of the packing hole (67) and coupled to the coupling rod (664) of the air entrance/exit member (66); an expansion part (672) which is formed at the lower portion of the packing hole (67) for opening or closing the coupling hole (621) of the sealing cap (60); and a resilient part (673) which is formed at an upper portion of the packing (67) for elastically and upwardly supporting the cover plate (663) of the air entrance/exit member (66) to allow the expansion part (672) to close the coupling hole (621) of the sealing cap (60).

Advantageous Effects

According to the cosmetic container of the present invention, the air entrance/exit member is installed on a sealing cap to prevent air therein from being compressed when the cosmetic container is closed with the sealing cap, so that the sealing cap may be prevented from being opened while bouncing upward.

In addition, according to the cosmetic container of the present invention, the handle having a hinge, which is provided on an air entrance/exit member installed on a sealing cap, may prevent a pressure reducing phenomenon from occurring when opening the sealing cap, so that the sealing cap may be prevented from being not opened due to vacuum.

In addition, according to the cosmetic container of the present invention, the packing is installed on an air entrance/exit member installed on a sealing cap such that the sealing may be improved and the air entrance/exit member may be easily assembled with the sealing cap.

In addition, according to the cosmetic container of the present invention, the sealing protrusion wheel, which extends from the lower surface of the sealing cap, is tightly press-inserted into the inlet of the cosmetic container, so that the cosmetic container may be perfectly sealed.

In addition, according to the cosmetic container of the present invention, the sealing protrusion wheel of the sealing cap is tightly press-inserted into the sealing extension protrusion wheel which extends integrally from an inlet of the sealing cap, such that the sealing of the cosmetic container may be enhanced.

BEST MODE

Mode for Invention

Hereinafter, a cosmetic container having an air entrance/exit member according to the first embodiment of the present invention will be described with reference to accompanying drawings.

Figure 1:
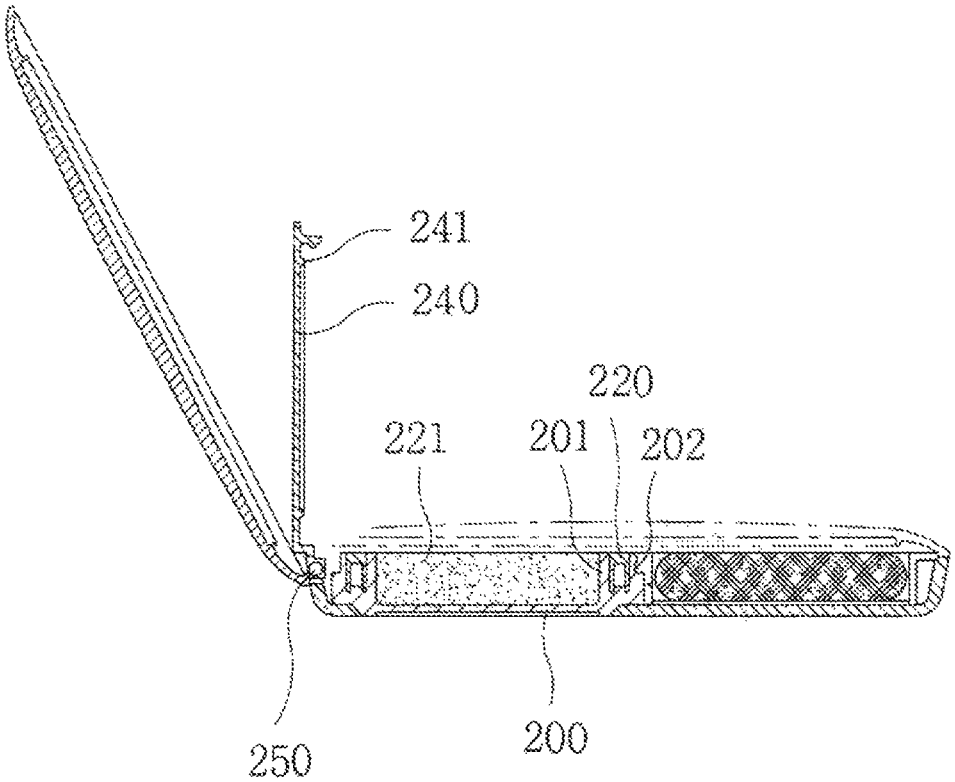
FIG. 1 is a sectional view showing a cosmetic container having a sealing cap according to the related art.
Figure 2:
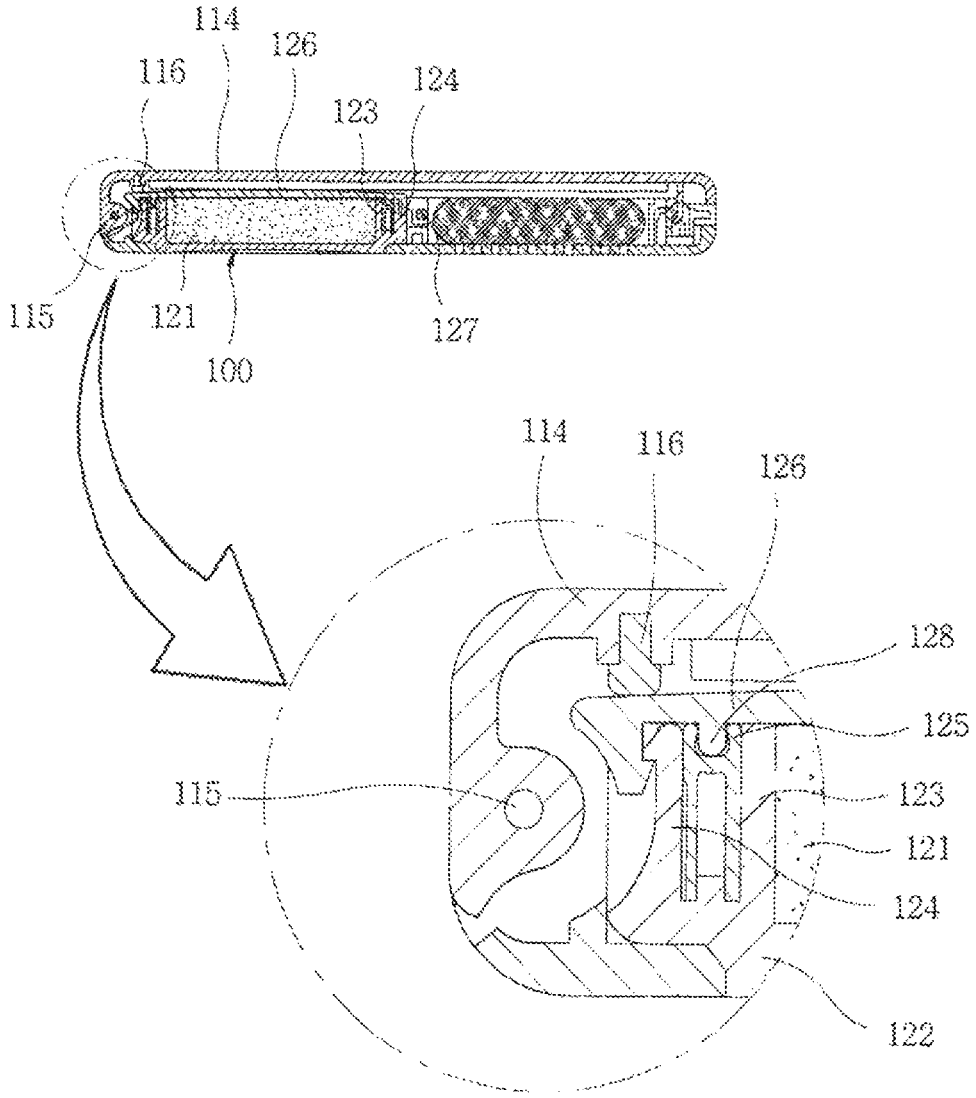
FIG. 2 is a sectional view showing a cosmetic container having a sealing-enhanced sealing cap according to the related art.
Figure 3:
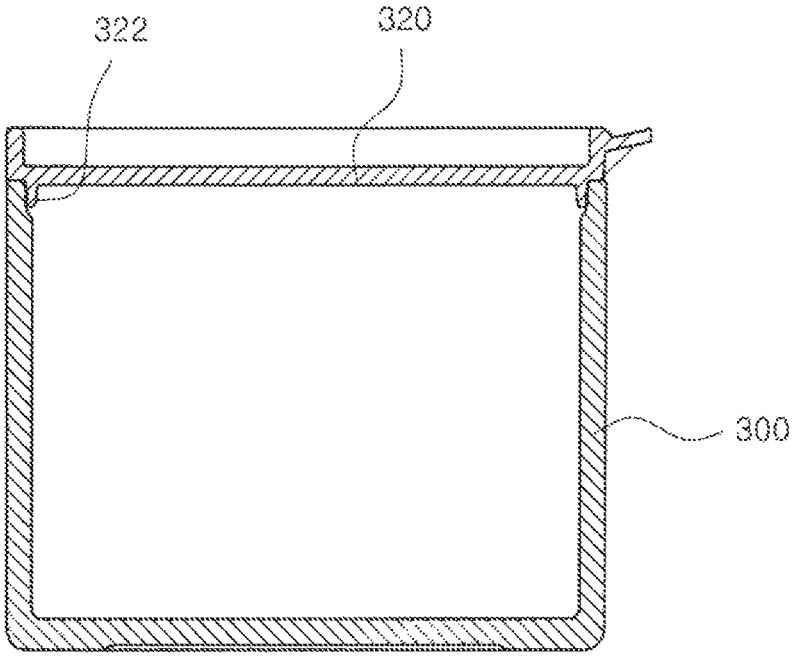
FIG. 3 is a sectional view showing a cosmetic container having a sealing cap provided with a sealing protrusion wheel according to the related art.
Figure 4:
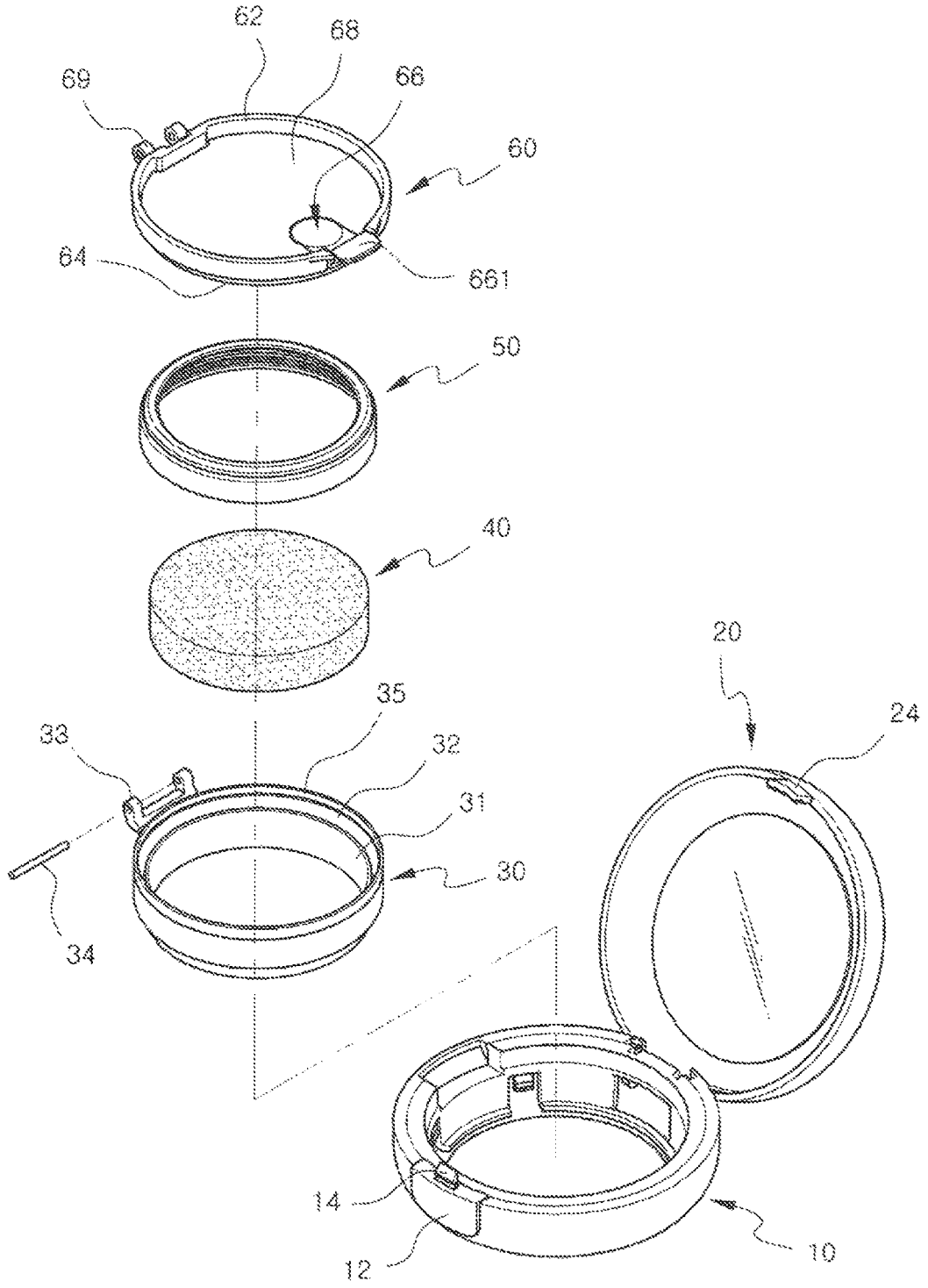
FIG. 4 is an exploded perspective view showing a cosmetic container having an air entrance/exit member according to the present invention.
Figure 5:
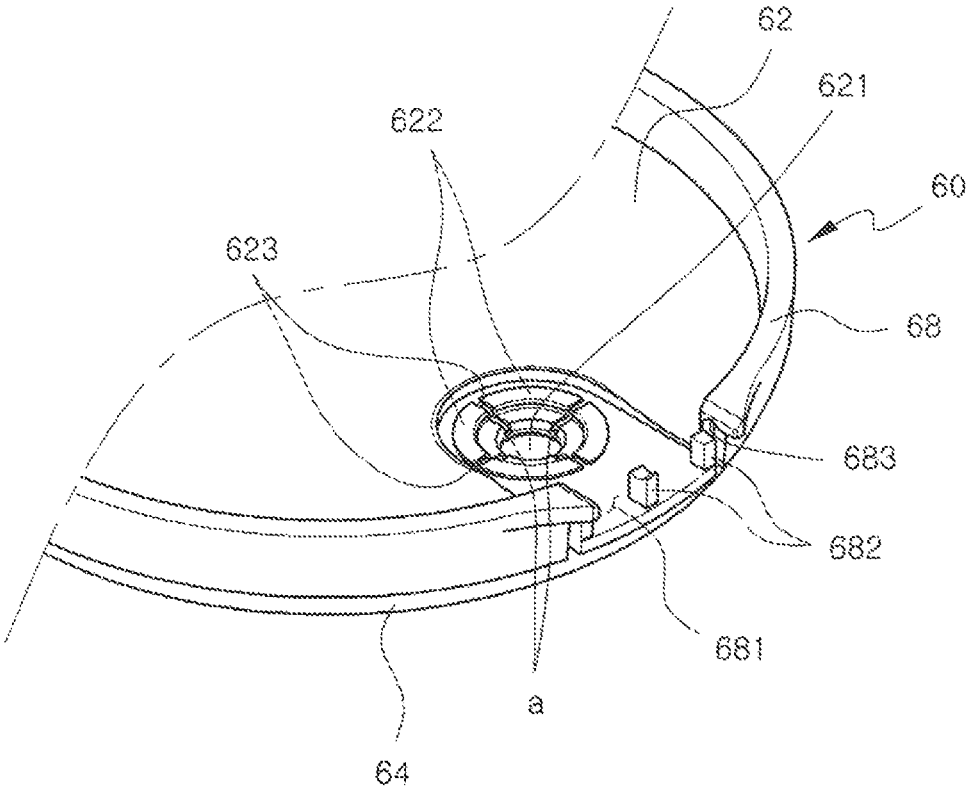
FIG. 5 is a partial perspective view of a sealing cap applied to the present invention.
Figure 6:
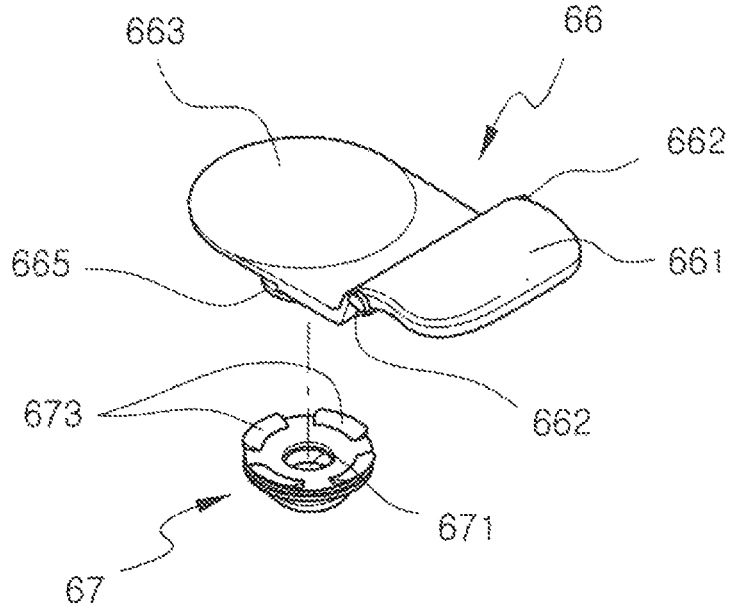
FIG. 6 is a perspective view showing an air entrance/exit member and a packing applied to the present invention.
Figure 7:
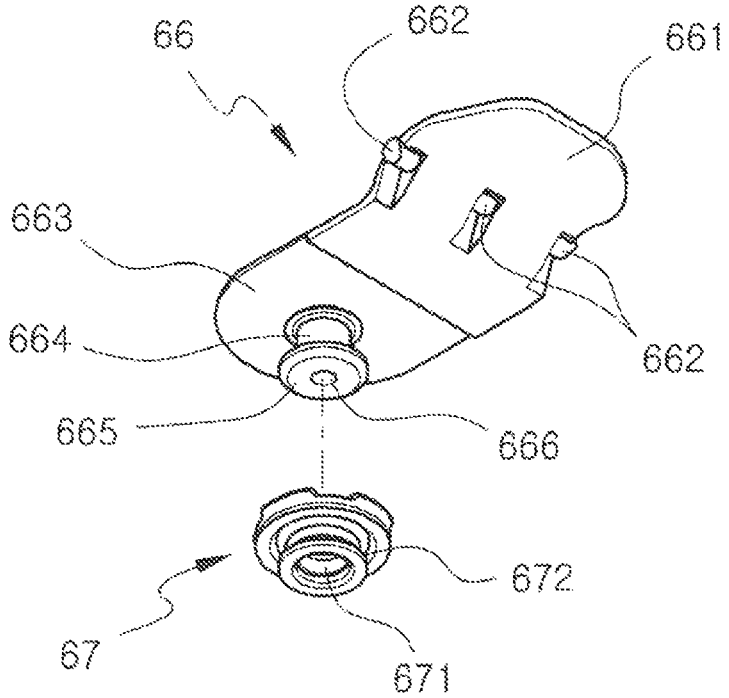
FIG. 7 is a bottom perspective view showing an air entrance/exit member and a packing applied to the present invention.
Figure 8:
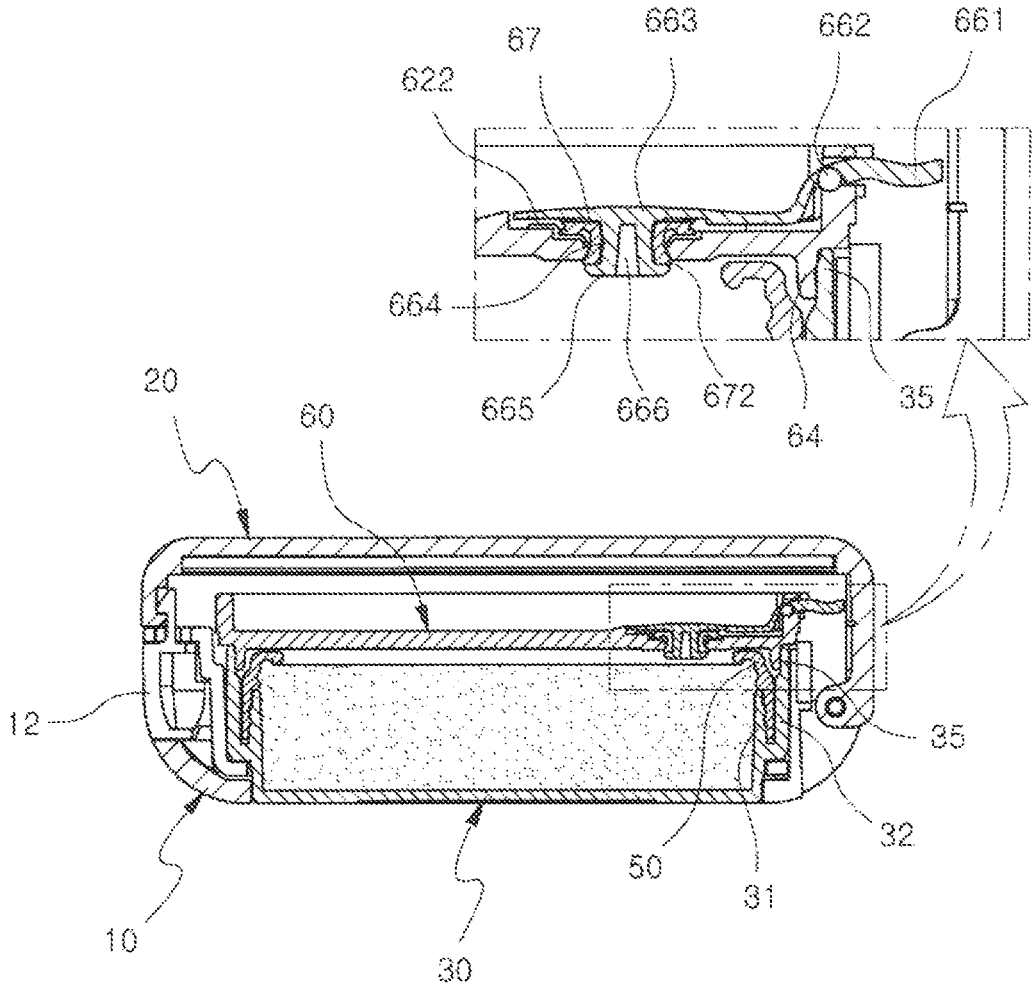
FIG. 8 is a sectional view showing a cosmetic container having an air entrance/exit member according to the present invention.

FIG. 4 is an exploded perspective view showing a cosmetic container having an air entrance/exit member according to the present invention. FIG. 5 is a partial perspective view of a sealing cap applied to the present invention. FIG. 6 is a perspective view showing an air entrance/exit member and a packing applied to the present invention. FIG. 7 is a bottom perspective view showing an air entrance/exit member and a packing applied to the present invention. FIG. 8 is a sectional view showing a cosmetic container having an air entrance/exit member according to the present invention.

According to the present invention, an outer container cap 20 is hinge coupled to an outer container 10 to be opened or closed and a cosmetic container 30 is coupled to an inside of the outer container 10 such that the cosmetic container 30 is opened or closed by a sealing cap 60.

A button 12 from which a coupling protrusion 14 protrudes is installed onto one side surface of the outer container 10. When a nook 24 is formed on the outer container cap 20 and the outer container cap 20 is hinge coupled to the outer container 10, the hook 24 of the outer container cap 20 is coupled to the coupling protrusion 14 of the button 12, such that the outer container cap 20 may be opened or closed.

Then, when the button 12 is pushed to open the outer container cap 20, the coupling protrusion 14 moves back so that the coupling protrusion 14 is released from the hook 24, so the outer container cap 20 can be opened from the outer container 10.

The cosmetic container 30 is inserted into the outer container 10 to be coupled. Cosmetics may be directly filled into the cosmetic container 30. Alternatively, after cosmetics are impregnated in an impregnated member 40, the impregnated member 40 may be installed in the outer container 10.

When the impregnated member 40 is installed in the cosmetic container 30, a fixing piece 50 is coupled between inner and outer walls 31 and 32 of the cosmetic container 30 such that the impregnated member (40) may be prevented from being separated from the cosmetic container 30.

The sealing cap 60 is closed by putting the sealing cap 60 on the cosmetic container 30. The sealing cap 60 may be closed without any hinges or may be hinge coupled to the cosmetic container 30 as shown in FIG. 4.

When the sealing cap 60 is coupled to the cosmetic container 30 through a hinge, a first hinge block 33 may be formed on an outer side surface of one side of the cosmetic container 30 and a second hinge block 60, which is coupled to the first hinge blocks 33, other may be formed on an outer side surface of one side of the sealing cap 60.

According the present invention, a cosmetic container having an air entrance/exit member includes an outer container 10, an outer container cap 20 opened or closed on the outer container 10, a cosmetic container 30 coupled to an inside of the outer container 10, and a sealing cap 60 opened or closed on the cosmetic container 30, wherein the sealing cap 60 includes a sealing plate 62 for covering the cosmetic container 30, a sealing protrusion wheel 64 formed at the lower surface of the sealing plate 62, and an air entrance/exit member 66 installed to the sealing plate 62.

A coupling hole 621, into which the air entrance/exit member 66 is coupled, is formed in the sealing plate 62, and a plurality of ribs 622 is formed near the coupling hole 621 so that slits 623 through which air flows are formed between the ribs 622.

Since, although the slit 623 is a passage through which air flows, the slit 623 must be easily closed when the coupling hole 621 is closed, it is preferable that the slit 623 is not formed at the lowest end a of the coupling hole 621.

The coupling hole 621 is coupled to the air entrance/exit member 66 and serves as a passage, through which the compressed air generated when the cosmetic container 30 is closed with the sealing cap 60, flows out. In addition, the coupling hole 621 serves as an air passage through which the vacuum pressure generated when the cosmetic container is opened with the sealing cap (60) is removed.

Although the coupling hole 621 is an air passage, the coupling hole 621 must be perfectly sealed when the cosmetic container 30 is closed with the sealing cap 60. Thus, since there is no need to form the coupling hole 621 to be larger than necessary, it is preferable to form the coupling hole 621 at the minimum size sufficient to be coupled to the air entrance/exit member 66 and allow air to flow therethrough. Preferably, the coupling hole 621 has a diameter in the range of 3~10 mm.

A reinforcing band 68 protrudes integrally from an outer periphery surface of the sealing plate 62 and a cut surface 681, into which a handle 661 is inserted, is formed at one side of the reinforcing band 68. A hinge support 682 for supporting a hinge 662 of the handle 661 of the air entrance/exit member 66 is formed on the cut surface 681, and hinge holes 683, into which the hinges 662 of the handle 661 of the air entrance/exit member 66 are inserted, are formed on both side ends of the reinforcing band 68 which are formed by the cut surface 681.

Preferably, an upper surface of the hinge support 682 is formed in an arc shape such that the hinge 662 is smoothly rotated. In addition, preferably, three hinge supports 682 are provided to stably support the air entrance/exit member 66.

Preferably, the sealing protrusion wheel 64 is formed of a material such as polypropylene (PP) or polyethylene (PE) having strength and elasticity to increase the sealing. Preferably, an outer diameter of the sealing protrusion wheel 64 is greater than an inner diameter of the inlet of the cosmetic container 30, into which the sealing protrusion wheel 64 is inserted, by 0.01~0.03 mm.

The air entrance/exit member 66 includes a cover plate 663 for covering the upper portion of the coupling hole 621 of the sealing cap 60, a coupling rod 664 integrated with a lower portion of the cover plate 663 and inserted into the coupling hole 621 of the sealing cap 60, and a packing-separation preventing protrusion wheel 665 integrally extending from an end of the coupling rod 664 such that the packing 67 is prevented from being separated.

In addition, a shrinkage hole 666 may be formed at the center of the coupling rod 664 to allow the coupling rod 664 to shrink such that the sealing cap 60 is easily coupled into the coupling hole 621. In order to prevent the packing-separation preventing protrusion wheel 665 on the end of the coupling rod 664 from be separated from the coupling hole 621 of the sealing cap 60, the packing-separation preventing protrusion wheel 665 is preferably formed to have a diameter larger than that of the coupling hole 621 of the sealing cap 60 by 0.01~1.0 mm.

When the packing-separation preventing protrusion wheel 665 is forcibly inserted into the coupling hole 621 of the sealing cap 60 to couple packing-separation preventing protrusion wheel 665 to the sealing cap 60, the packing-separation preventing protrusion wheel 665 is inserted into the coupling hole 621 of the sealing cap 60 while the shrinkage hole 666 formed at the center of the coupling rod 664 shrinks.

The handle 661 may be integrally formed at one side of the air entrance/exit member 66, and the hinge 662, which is inserted into a hinge hole 663 and is put on the hinge support 682 of the sealing cap 60, is formed in the handle 661.

The packing 67, which is fitted with the coupling rod 664 of the air entrance/exit member 66, is not separated from the coupling rod 664 by the packing-separation preventing protrusion wheel 665 on the end of the coupling rod 664.

The packing 67 includes a coupling hole 671 which is formed at the center of the packing 67 and coupled to the coupling rod 664 of the air entrance/exit member 66, an expansion part 672 formed at the lower portion of the packing 67 for opening or closing the coupling hole 621 of the sealing cap 60, and a resilient part 673 which is formed at an upper portion of the packing 67 for elastically and upwardly supporting the cover plate 663 of the air entrance/exit member 66 to allow the expansion part 672 to close the coupling hole 621 of the sealing cap 60.

Since the resilient part 673 elastically supports the body of the packing 67 and the cover plate 663 therebetween, the resilient part 673 may be replaced as elastic means such as a spring.

The packing 67 is formed of a material having superior elasticity to enhance the sealing. In addition, when the packing 67 makes contact with the cosmetics contained in the cosmetic container 30 while the volatile ingredients are volatilized, since the property of the packing 67 must not be changed, the packing 67 is preferably formed of one of synthetic resin, elastomer, silicon rubber and NBR rubber having superior elasticity.

Preferably, the sealing extension protrusion wheel 35 extends integrally from the inlet of the cosmetic container 30 and is formed of a material such as polypropylene (PP) or polyethylene (PE) having strength and elasticity to increase the sealing.

As shown in FIG. 8, according to the present invention, the cosmetic container 30 is provided with a side including inner and outer walls 31 and 32 to which the fixing piece 50 is coupled. In this case, preferably, the sealing extension protrusion wheel 35 extends integrally from an upper side end of the outer wall 32 such that the sealing protrusion wheel 64 the sealing cap 60 is coupled to the sealing extension protrusion wheel 35.

Preferably, an inner diameter of the sealing extension protrusion wheel 35 is less than an outer diameter of the sealing protrusion wheel 64 by 0.1~0.3 mm to enhance the sealing. In order to allow the gap of the sealing extension protrusion wheel 35 to be outwardly widened when the sealing protrusion wheel 64 is inserted thereinto, the inner diameter of the sealing extension protrusion wheel 35 is preferably thinner than a thickness of the outer 32 or the inlet of the cosmetic container 30.

Hereinafter, a cosmetic container having an air entrance/exit member according to another embodiment of the present invention will be described.

Figure 9:
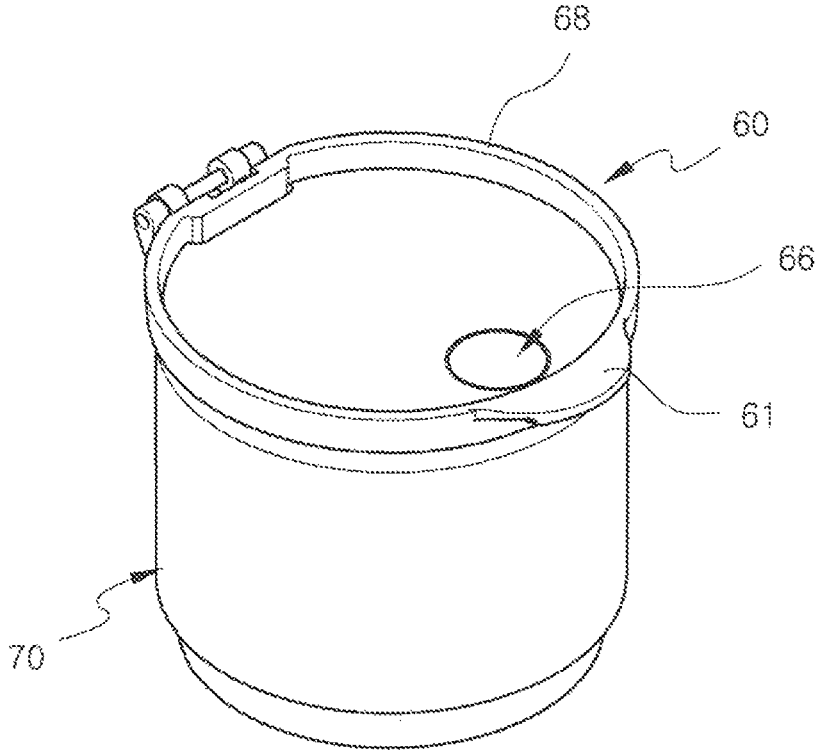
FIG. 9 is a perspective view showing the cosmetic cream container and sealing cap of a cosmetic container having an air entrance/exit member coupled to each other according to another embodiment of the present invention.
Figure 10:
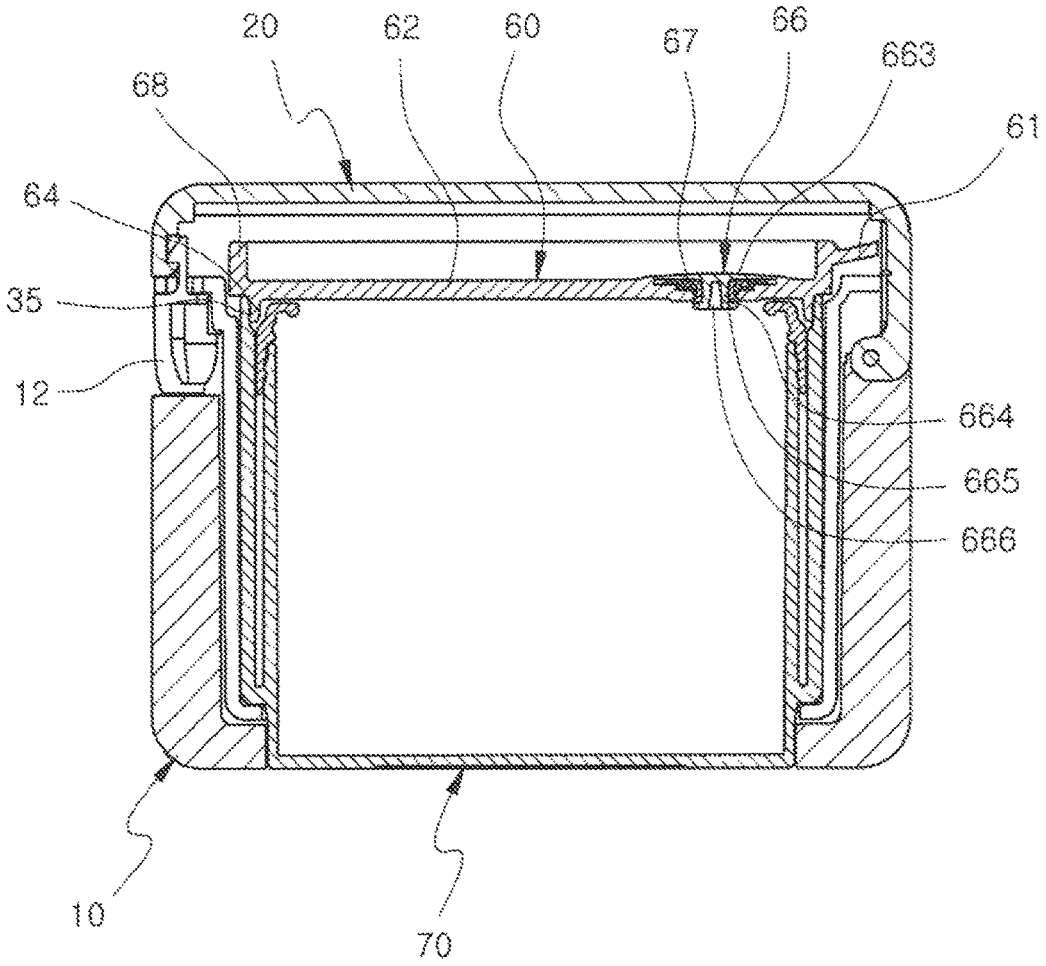
FIG. 10 is a sectional view showing a cosmetic container having an air entrance/exit member according to another embodiment of the present invention.

FIG. 9 is a perspective view showing the cosmetic cream container and sealing cap of a cosmetic container having an air entrance/exit member coupled to each other according to another embodiment of the present invention. FIG. 10 is a sectional view showing a cosmetic container having an air entrance/exit member according to another embodiment of the present invention.

The cosmetic container having an air entrance/exit member according to another embodiment of the present invention includes a cosmetic cream container 70 which has a deep depth and is covered by a sealing cap 60 to be sealed, an outer container 10 into which the cosmetic cream container 70 is inserted to be coupled thereto, and an outer container cap 20 which is hinge coupled to the outer container 10.

The sealing cap 60 includes a sealing plate 62 covering the cosmetic cream container 70, a sealing protrusion wheel 64 formed on the lower surface of the sealing plate 62, and an air entrance/exit member 66 inserted into and installed to the sealing plate 62.

Differently from the first embodiment, a handle is not formed on the air entrance/exit member 66 but on the reinforcing band 68 of the sealing cap 60. In the following description, the same elements of another embodiment as those of the first embodiment will be assigned with the same reference numerals and the details may be referenced with the drawings for the first embodiment.

Similarly with the first embodiment described above, a coupling hole 621, to which the air entrance/exit member 66 is coupled, is formed in the sealing plate 62, and a plurality ribs 622 is formed near the coupling hole 621 so that slits 623, through which air flows, are formed between the ribs 622.

The air entrance/exit member 66 includes a cover plate 663 for covering the upper portion of the coupling hole 621 of the sealing cap 60, a coupling rod 664 integrated with a lower portion of the cover plate 663 and inserted into the coupling hole 621 of the sealing cap 60, and a packing-separation preventing protrusion wheel 665 integrally extending from an end of the coupling rod 664 to prevent the packing 67 from being separated. A shrinkage hole 666 may be formed at the center of the coupling rod 664 such that the sealing cap 60 is easily coupled into the coupling hole 621.

Preferably, the sealing extension protrusion wheel 35 extends integrally from an inlet of the cosmetic cream container 70.

Hereinafter, a cosmetic container having an air entrance/exit member according to still another embodiment of the present invention will be described.

Figure 11:
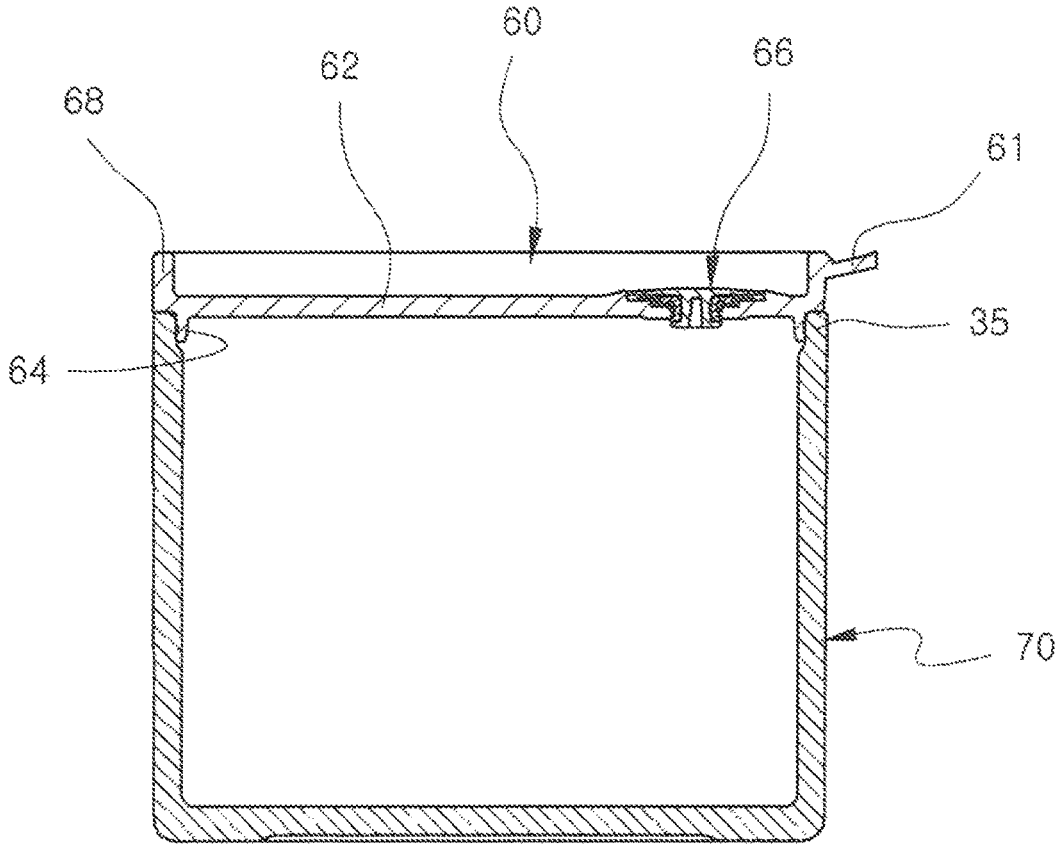
FIG. 11 is a sectional view showing a cosmetic container having an air entrance/exit member according to still another embodiment of the present invention.

FIG. 11 is a sectional view showing a cosmetic container having an air entrance/exit member according to still another embodiment of the present invention.

A cosmetic container having an air entrance/exit member according to still another embodiment of the present invention includes a cosmetic cream container 70 having a deep depth and a sealing cap 60 covering the cosmetic cream container 70 to seal the cosmetic cream container 70 without any outer containers.

The sealing cap 60 includes a sealing plate 62 covering the cosmetic cream container 70, a sealing protrusion wheel 64 formed on the lower surface of the sealing plate 62, and an air entrance/exit member 66 inserted into and installed to the sealing plate 62.

Differently from another embodiment, a handle is not formed on the air entrance/exit member 66 but on the reinforcing hand 68 of the sealing cap 60. In the following description, the same elements of another embodiment as those of the first embodiment will be assigned with the same reference numerals and the derails may be referenced with the drawings for the first embodiment Similarly with the first embodiment described above, a coupling hole 621, to which the air entrance/exit member 66 is coupled, is forced in the sealing plate 62, and a plurality ribs 622 is formed near the coupling hole 621 so that slits 623, through which air flows, are formed between the ribs 622.

The air entrance/exit member 66 includes a cover plate 663 for covering the upper portion of the coupling hole 621 of the sealing cap 60, a coupling rod 664 integrated with a lower portion of the cover plate 663 and inserted into the coupling hole 621 of the sealing cap 60, and a packing-separation preventing protrusion wheel 665 integrally extending from an end of the coupling rod 664 to prevent the packing 67 from being separated. A shrinkage hole 666 may be formed at the center of the coupling rod 664 such that the sealing cap 60 is easily coupled into the coupling hole 621.

Preferably, the sealing extension protrusion wheel 35 extends integrally from an inlet of the cosmetic cream container 70.

Hereinafter, a cosmetic container having an air entrance/exit member according to still another embodiment of the present invention will be described.

Figure 12:
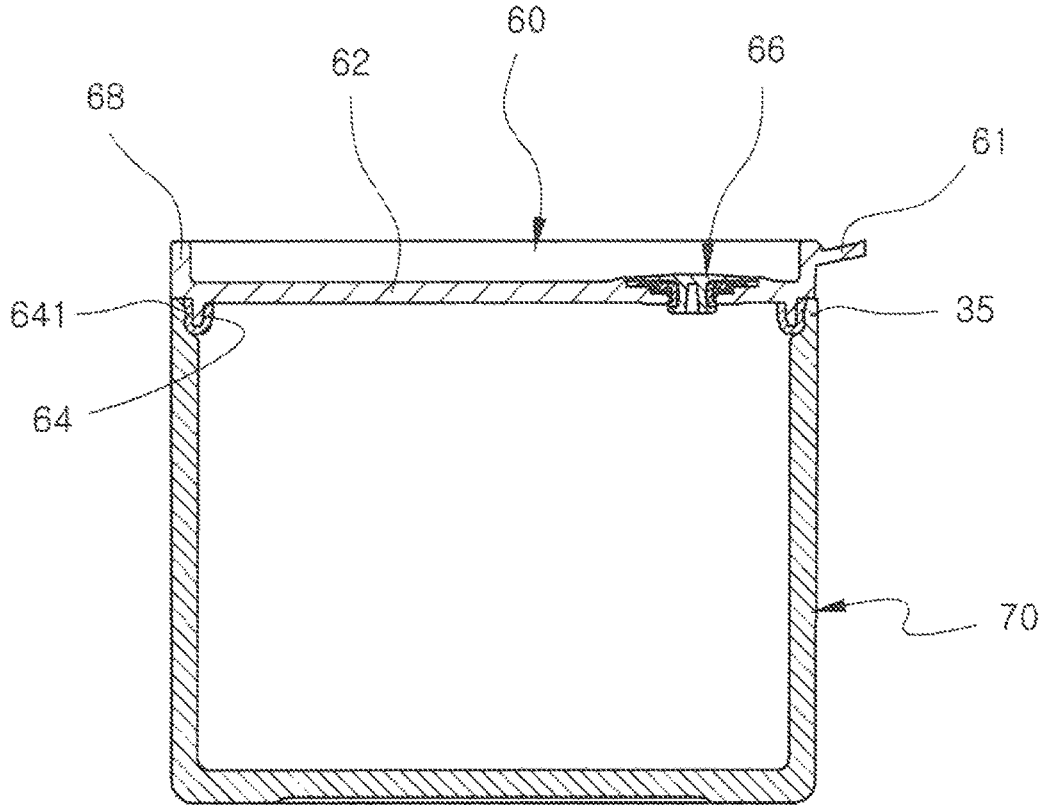
FIG. 12 is a sectional view showing a cosmetic container having an air entrance/exit member on which a sealing protrusion packing is further formed according to still another embodiment of the present invention.

FIG. 12 is a sectional view showing a cosmetic container having an air entrance/exit member on which a sealing protrusion packing is further formed according to still another embodiment of the present invention.

A sealing protrusion wheel packing 641 may be further formed on the sealing protrusion wheel 64 of the sealing cap 60 according to the present invention. Preferably, the sealing protrusion wheel packing 641 is formed of one of synthetic resin, elastomer, silicon rubber and NBR rubber having superior elasticity.

Hereinafter, a cosmetic container having an air entrance/exit member according to still another embodiment of the present invention will be described.

Figure 13:
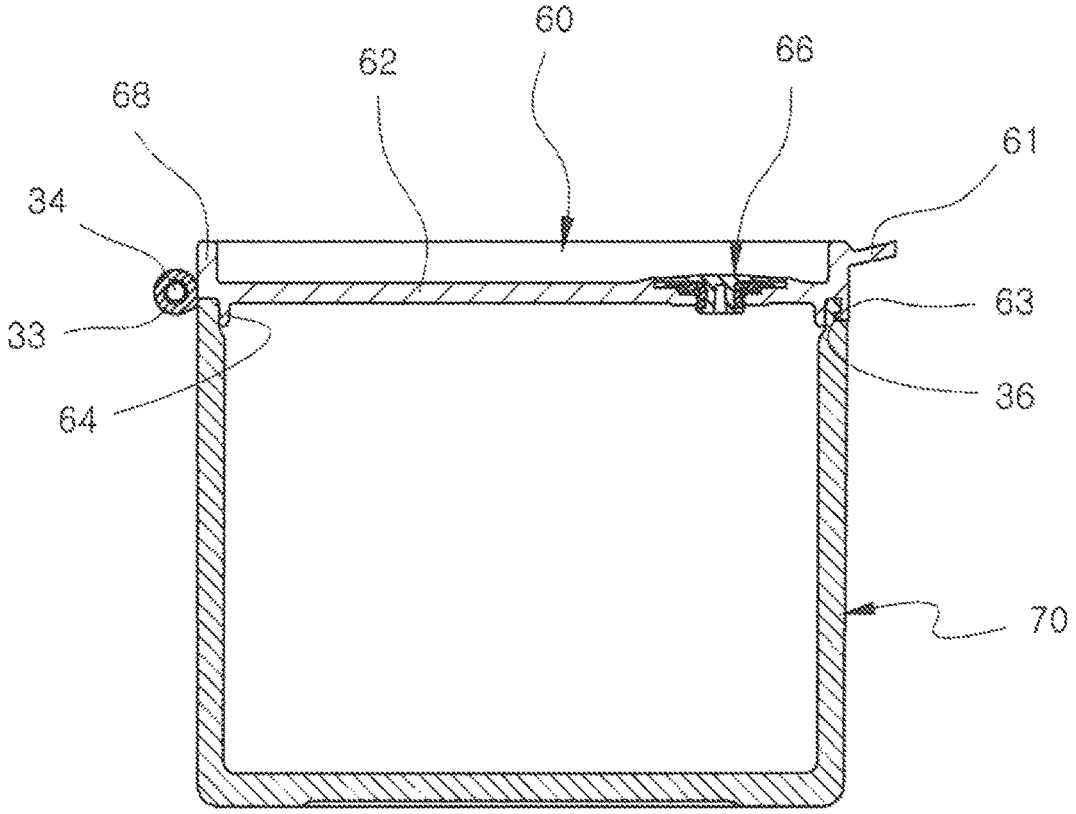
FIG. 13 is a sectional view showing a cosmetic container having an air entrance/exit member on which an assembly protrusion is further formed according to still another embodiment of the present invention.

FIG. 13 is a sectional view showing a cosmetic container having an air entrance/exit member on which an assembly protrusion is further formed according to still another embodiment of the present invention.

An assembly protrusion 63 may be further formed on one side surface of the sealing cap 60, and an assembly groove 36 may be further formed on the cosmetic container 30 or a cosmetic cream container 70 such that the sealing may be enhanced.

Hereinafter, a method of assembling the cosmetic container having an air entrance/exit member according to the present invention will be described as follows.

Except for the sealing cap, the remaining elements of the embodiment are the same as those of the related art. That is, after the outer container cap 20 is hinge-coupled to the outer container 10, the cosmetic container 30 is inserted into the outer container 10 to be coupled to the outer container 10, in which cosmetics are directly filled in the cosmetic container 30 or accommodated in the cosmetic container 30 while being impregnated in an impregnated member 40.

Then, a fixing piece 50 is coupled between inner and outer walls 31 and 32 of the cosmetic container 30 to fix the impregnated member 40 such that the impregnated member 40 is prevented from being separated from the cosmetic container 30. A sealing cap 60 is hinge-coupled to the cosmetic container 30 with a hinge pin 34.

Next, a method of coupling the air entrance/exit member 66 to the sealing plate 60 of the sealing cap 60 will be described.

First, the coupling rod 664 of the air entrance/exit member 66 is fitted into the coupling hole 671 of the packing 67 so that the packing 67 is coupled to the coupling rod 664. In this case, since the packing 67 is formed of a material having superior elasticity, even though the coupling hole 671 of the packing 67 is smaller than the extension part 672 of the coupling rod 664, it is possible to fit the packing 67 into the coupling hole 671 of the packing 67.

The packing 67 fitted with the coupling rod 664 once is not separated from the coupling rod 664 due to the extension part 672 formed on the end of the coupling rod 664.

Then, the coupling rod 664 of the air entrance/exit member 66 coupled to the packing 67 is press-inserted into a coupling hole 621 of the sealing cap 60. In this case, since the size of the packing-separation preventing protrusion wheel 665 of the coupling rod 664 is greater than the diameter of the coupling hole 621 of the sealing cap 60, the packing-separation preventing protrusion wheel 665 is forcibly inserted into the coupling hole 621. However, due to the shrinkage hole 666 formed at the center of the coupling rod 664, the coupling rod 664 may be forcibly inserted into the coupling hole 621 of the sealing cap 60 while shrinking.

According to the cosmetic container having an air entrance/exit member according to another embodiment or still another embodiment, although the air entrance/exit member 66 is coupled to the coupling hole 621 of the sealing cap 60 in the same manner described above, in the cosmetic container having an air entrance/exit member according to the first embodiment, after coupling, the handle 661 extending from the air entrance/exit member 66 must be coupled to the cut surface 681 of the sealing cap 60.

That is, after the hinge 662 of the air entrance/exit member 66 are put on the hinge support 682 of the sealing cap 60, the hinge 662 formed on both side ends of the air entrance/exit member 66 is fitted into the hinge hole 683 formed in the reinforcing band 68.

Hereinafter, a using state of the cosmetic container having an air entrance/exit member according to an embodiment will be described as follows.

Figure 14:
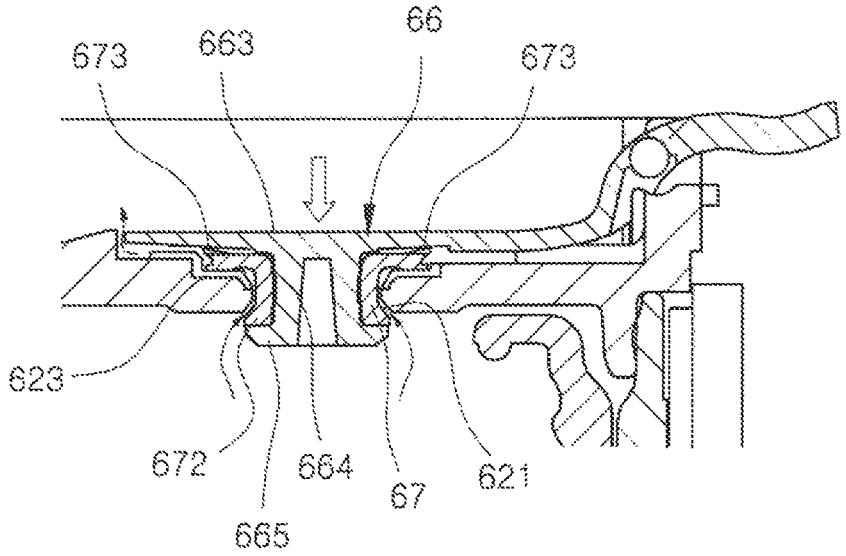
FIG. 14 is a view showing a state that the air in a cosmetic container is discharged by pushing a cover plate of an air entrance/exit member applied to the present invention.
Figure 15:
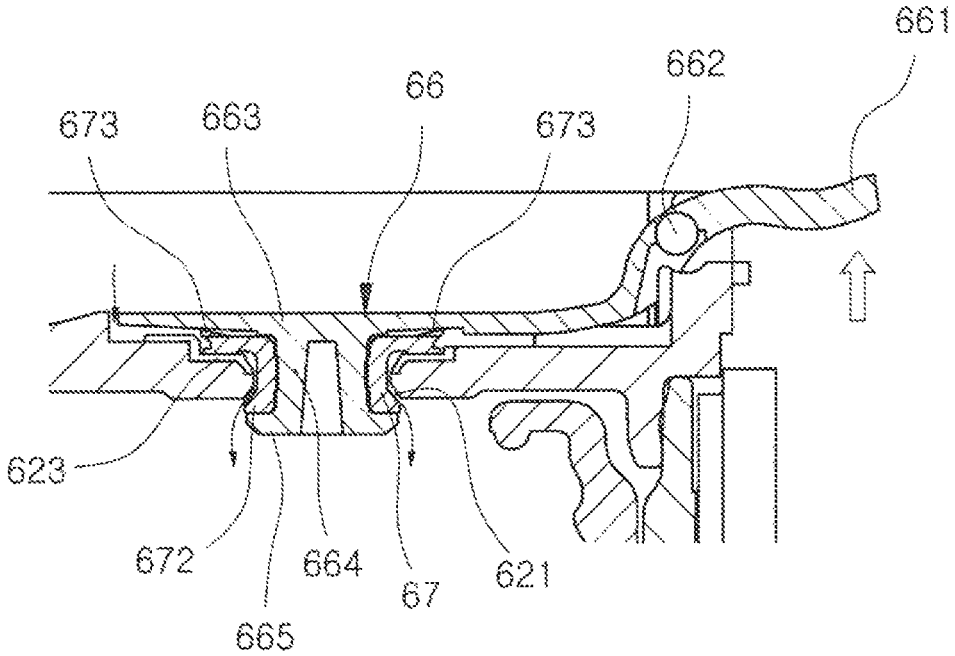
FIG. 15 is a view showing a state that air is introduced in a cosmetic container by lifting up a handle of an air entrance/exit member applied to the present invention.

FIG. 14 is a view showing a state that the air in a cosmetic container is discharged by pushing a cover plate of an air entrance/exit member applied to the present invention. FIG. 15 is a view showing a state that air is introduced in a cosmetic container by lifting up a handle of an air entrance/exit member applied to the present invention.

First, the state that the cosmetic container 30 is closed with the sealing cap 60 will be described with reference to FIG. 8. As the sealing protrusion wheel 64 of the sealing cap 60 is tightly inserted into the sealing extension protrusion wheel 35 of the cosmetic container 30, the sealing of the cosmetic container 30 starts.

In this case, air is compressed as much as the sealing protrusion wheel 64 is inserted into the sealing extension protrusion wheel 35 while the cosmetic container 30 is sealed by the sealing cap 60, so that the sealing cap 60 is pushed upwardly by the compressed air, so the cosmetic container 30 is not fully closed with the sealing cap 60.

In this case, as shown in FIG. 14, when the cosmetic container 30 is closed with the sealing cap 60 while the cover plate 663 of the air entrance/exit member 66 is pushed downward, while the resilient part 673 formed on the upper surface of the packing 67 is compressed by the pressure on the cover plate 663, the extension part 672 of the packing 67 is pushed downward to move down together with the coupling rod 664.

Then, a gap is created between the expansion part 672 of the packing 67 and the coupling hole 621 of the sealing cap 60, so that the compressed air generated in the cosmetic container 30 is output through the gap and discharged through the slits 623, so the sealing cap 60 is tightly inserted into to the cosmetic container 30.

Thereafter, when the pressure on the cover plate 663 of the air entrance/exit member 66 is removed, the resilient part 673 of the packing 67 elastically supports the cover plate 663 to push the cover plate 663 upward while returning to the original state. Thus, the end a of the coupling hole 621 of the sealing cap 60 is shut off while the coupling rod 664 and the expansion part 672 of the packing 67 move up together with the cover plate 673.

At this time, the packing-separation preventing protrusion wheel 665 formed on the end of the coupling rod 664 lifts up the extension part 672 of the packing 67, so that the packing 67 is not separated from the coupling rod 664 by the packing-separation preventing protrusion wheel 665.

As described above, there is no worry of the evaporation of water and the volatilization of volatile ingredients in the cosmetic container 30 sealed by the sealing cap 60.

When the cosmetics contained in the cosmetic container 30 are used in future, the sealing cap 60 is pulled upward. Since the cosmetic container 30 is sealed with the sealing cap 60, if the sealing cap 60 is pulled upward to be opened, a pressure reducing phenomenon occurs as the sealing protrusion wheel 64 of the sealing cap 60 is away from the sealing extension protrusion wheel 35 of the cosmetic container 30, so that the inside of the cosmetic container 30 is vacuum, so the sealing cap 60 is not opened.

In this case, as shown in FIG. 15, when the handle 661 of the air entrance/exit member 66 is lifted up, the cover plate 663 moves down by the hinge 665, so that the expansion part 672 of the packing 67 is pushed to move down together with the coupling rod 664 while the resilient part 673 formed on the upper surface of the packing (67) is compressed.

Then, a gap is created between the expansion part 672 of the packing 67 and the coupling hole 621 of the sealing cap 60, so that the vacuum is removed by the pressure reducing phenomenon while external air is absorbed into the cosmetic container 30, so the sealing cap 60 is opened.

The foundation container provided with a cosmetic container having an air entrance/exit member described in this disclosure is for an illustrative purpose only and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Outer container
20: Outer container cap
30: Cosmetic container
35: Sealing extension protrusion wheel
40: Impregnated member
50: Fixing piece
60: Sealing cap
62: Sealing plate
621: Coupling hole
623: Slit
64: Sealing protrusion wheel
66: Air entrance/exit member
661: Handle
662: Hinge
663: Cover plate
664: Coupling rod
665: Packing-separation preventing protrusion wheel
666: Shrinkage hole
67: Packing
671: Coupling hole
672: Extension part
673: Resilient part
68: Reinforcing band
681: Cut surface
682: Hinge support
683: Hinge hole

The invention claimed is:

1. A cosmetic container having an air entrance/exit member (66), an outer container (10), an outer container cap (20) opened or closed on the outer container (10), a cosmetic container (30) coupled to an inside of the outer container (10) and a sealing cap (60) opened or closed on the cosmetic container (30), wherein the sealing cap (60) comprises:

a sealing plate (62) for covering the cosmetic container (30);

a sealing protrusion wheel (64) formed at a lower surface of the sealing plate (62); and the air entrance/exit member (66) installed to the sealing plate (62), wherein a coupling hole (621) into which the air entrance/exit member (66) is coupled is formed in the sealing plate (62), and wherein a coupling rod (664) is constructed to attach orthogonally to a cover plate (663) of the air entrance/exit member (66) wherein the coupling rod (664) fits into a coupling hole (671) formed by the packing (67) such that the packing (67) is coupled to the air entrance/exit member (66), wherein the coupling hole (621) is constructed to receive the packing (67) that is coupled to the air entrance/exit member (66), wherein when the air entrance/exit member (66) is pushed downward, the packing (67) also moves downward together to compress a resilient part (673) formed on an upper surface of the packing (67) to introduce or discharge air, and wherein a plurality of ribs (622) surround and line the coupling hole (621).

2. The cosmetic container of claim 1, wherein a slit (623), formed between the ribs (622), is constructed to permit air flow.

3. The cosmetic container of claim 2, wherein the slit (623) is not formed at a lowest end (a) of the coupling hole (621).

4. The cosmetic container of claim 1, wherein a handle (661) is formed on one side of the air entrance/exit member (66) and a hinge (662) is formed on the handle (661).

5. The cosmetic container of claim 1, wherein a reinforcing band (68) is integrally formed on an outer periphery of the sealing plate (62), and a cut surface (681) into which a handle (661) of the air entrance/exit member (66) is inserted is formed on one side of the reinforcing band (68).

6. The cosmetic container of claim 5, wherein a hinge support (682) for supporting a hinge (662) of the handle (661) of the air entrance/exit member (66) is formed on the cut surface (681), and a hinge hole (683), into which the hinge (662) of the handle (661) of the air entrance/exit member (66) is inserted, is formed on both side ends of the reinforcing band (68) which are formed by the cut surface (681).

7. The cosmetic container of claim 1, wherein the air entrance/exit member (66) includes:

a cover plate (663) for covering an upper portion of the coupling hole (621) of the sealing cap (60); and a packing-separation preventing protrusion wheel (665) integrally extending from an end of the coupling rod (664) to prevent the packing (67) from being separated, wherein the coupling rod (664) is integrated with a lower portion of the cover plate (663).

8. The cosmetic container of claim 7, wherein a shrinkage hole (666) is formed in the coupling rod (664).

9. A cosmetic container having an air entrance/exit member, an outer container (10), an outer container cap (20) hinge-coupled to the outer container (10), a cosmetic container (30) inserted into the outer container (10) to be coupled to the outer container (10), in which cosmetics are directly filled in the cosmetic container (30) or accommodated in the cosmetic container (30) while being impregnated in an impregnated member (40), a fixing piece (50) coupled between inner and outer walls (31 and 32) of the cosmetic container (30) to fix the impregnated member (40) such that the impregnated member (40) is prevented from being separated from the cosmetic container (30), and a sealing cap (60) hinge-coupled to the cosmetic container (30), wherein a coupling rod (664), constructed to attach orthogonally to a cover plate (663) of the air entrance/exit member (66), fits into a coupling hole (671) formed by a packing (67) such that the packing (67) is coupled to the air entrance/exit member (66), the coupling rod (664) of the air entrance/exit member (66) coupled to the packing (67) is press-inserted into a coupling hole (621) of the sealing cap (60), and wherein a plurality of ribs (622) surround and line the coupling hole (621).

10. The cosmetic container claim 9, wherein the packing (67) is formed at a center thereof with the coupling hole (671) coupled to the coupling rod (664) of the air entrance/exit member (66);

the packing (67) is formed at a lower portion thereof with an expansion part (672) for opening or closing the coupling hole (621) of the sealing cap (60); and the packing (67) is formed at an upper portion thereof with a resilient part (673) for elastically and upwardly supporting the cover plate (663) of the air entrance/exit member (66) to allow the expansion part (672) to close the coupling hole (621) of the sealing cap (60).

11. A cosmetic container having an air entrance/exit member, in which, when the cosmetic container (30) is opened by upwardly pulling a sealing cap (60) from the cosmetic container (30), a pressure reduction occurs corresponding to a deviation of a sealing protrusion wheel (64) of the sealing cap (60) from an inlet of the cosmetic container (30), so that a vacuum is created in the cosmetic container (30), preventing the sealing cap (60) from being opened, wherein, when a handle (661) of the air entrance/exit member (66) is lifted up, a cover plate (663) moves down by a hinge (662) so that a resilient part (673) formed on an upper surface of a packing (67) is pushed to move down together with a coupling rod (664) of an expansion part (672) of the packing (67) while being compressed, so a gap is created between the expansion part (672) of the packing (67) and a coupling hole (621) of the sealing cap (60), and thus, external air is introduced into the cosmetic container (30) through a slit (623), the slit (623) formed between a pair of ribs (622), the vacuum caused by the pressure reduction is removed so that the sealing cap (60) is opened, wherein, when the handle (661) of the air entrance/exit member (66) returns to a starting position of the handle, the cover plate (663) returns to a starting position of the cover plate (663).

* * * * *